US009221162B2

(12) United States Patent
Kitagawa et al.

(10) Patent No.: US 9,221,162 B2
(45) **Date of Patent: *Dec. 29, 2015**

(54) PNEUMATIC DRIVING MACHINE

(75) Inventors: Hiroki Kitagawa, Hitachinaka (JP); Masashi Nishida, Hitachinaka (JP); Tetsuhito Shige, Hitachinaka (JP); Kousuke Akutsu, Hitachinaka (JP); Masaya Nagao, Hitachinaka (JP); Shouichi Hirai, Hitachinaka (JP)

(73) Assignee: HITACHI KOKI CO., LTD., Tokyo (JP)

( * ) Notice: Subject to any disclaimer, the term of this patent is extended or adjusted under 35 U.S.C. 154(b) by 120 days.

This patent is subject to a terminal disclaimer.

(21) Appl. No.: 13/124,014

(22) PCT Filed: Oct. 13, 2009

(86) PCT No.: PCT/JP2009/067967

§ 371 (c)(1),
(2), (4) Date: Apr. 13, 2011

(87) PCT Pub. No.: WO2010/044482

PCT Pub. Date: Apr. 22, 2010

(65) Prior Publication Data

US 2011/0198380 A1 Aug. 18, 2011

(30) Foreign Application Priority Data

Oct. 14, 2008 (JP) ..... 2008-265124
Sep. 30, 2009 (JP) ..... 2009-227230

(51) Int. Cl.
*B25C 5/00* (2006.01)
*B25C 1/04* (2006.01)
*B25C 1/00* (2006.01)

(52) U.S. Cl.
CPC ..... *B25C 1/041* (2013.01); *B25C 1/008* (2013.01)

(58) Field of Classification Search
CPC ..... B25C 1/06; B25C 1/08; B27F 7/38; B27F 7/36; B21J 15/28
USPC ..... 227/2, 8, 109, 120, 123, 128, 131, 134; 173/15, 127, 139
See application file for complete search history.

(56) References Cited

U.S. PATENT DOCUMENTS 3,685,396 A * 8/1972 Obergfell ..... 91/356
3,905,535 A 9/1975 Novak et al.

(Continued)

FOREIGN PATENT DOCUMENTS

EP 0 304 212 A2 2/1989
JP 53-93483 A 8/1978

(Continued)

OTHER PUBLICATIONS

Translation of Japanese Office Action issued in Japanese Applicaiton No. 2009-227230 dated Sep. 3, 2013.

(Continued)

*Primary Examiner* — Nathaniel Chukwurah
(74) *Attorney, Agent, or Firm* — McDermott Will & Emery LLP

(57) ABSTRACT

The nailing machine (1) comprises an air passage (510) allowing communication between a cylinder (200) and a return air chamber (500) in which compressed air for returning a piston (300) to the initial position is accumulated. The air passage (510) is provided with a control valve (520) controlling entry of compressed air into the return air chamber (500) from the cylinder (200). The control valve (520) opens the air passage (510) and allows entry of compressed air into the return air chamber (500) in the case wherein the nailed object produces a small reaction force upon driving the nail, namely when the upward moving distance of the body (100) relative to the push lever (700) is smaller than a predetermined distance. The compressed air that has entered the return air chamber (500) further enters a below-the-piston chamber and serves as air damper, reducing the driving force.

10 Claims, 11 Drawing Sheets

(56) References Cited

U.S. PATENT DOCUMENTS

| | | | | |
|---|---|---|---|---|
| 4,040,554 | A * | 8/1977 | Haytayan | 227/8 |
| 4,122,904 | A * | 10/1978 | Haytayan | 173/15 |
| 4,346,831 | A | 8/1982 | Haytayan | |
| 4,448,338 | A * | 5/1984 | Graf et al. | 227/8 |
| 4,497,377 | A * | 2/1985 | Haytayan | 173/15 |
| 4,523,646 | A | 6/1985 | Doyle et al. | |
| 4,717,060 | A * | 1/1988 | Cotta | 227/10 |
| 4,811,882 | A * | 3/1989 | Steeves et al. | 227/8 |
| 5,131,579 | A | 7/1992 | Okushima et al. | |
| 7,556,183 | B1 * | 7/2009 | Liang et al. | 227/130 |
| 8,479,963 | B2 * | 7/2013 | Kitagawa et al. | 227/8 |

FOREIGN PATENT DOCUMENTS

| | | |
|---|---|---|
| JP | 56-102489 A | 8/1981 |
| JP | 2003-136429 | 5/2003 |

OTHER PUBLICATIONS

Japanese Notification of Reasons for Rejection, w/ English translation thereof, issued in Japanese Patent Application No. JP 2009-227230 dated Dec. 3, 2013.

* cited by examiner

PNEUMATIC DRIVING MACHINE

RELATED APPLICATIONS

This application is the U.S. National Phase under 35 U.S.C. §371 of International Application No. PCT/JP2009/067967, filed on Oct. 13, 2009, which in turn claims the benefit of Japanese Application No. 2008-265124, filed on Oct. 14, 2008 and Japanese Application No. 2009-227230, filed on Sept. 30, 2009, the disclosures of which Applications are incorporated by reference herein.

TECHNICAL FIELD

The present invention relates to a pneumatic driving machine for driving fasteners such as nails and staples into an object.

BACKGROUND ART

It is a known technique in the prior art to adjust the distance between the tip of the push lever that abuts on an object into which a nail is driven ("the nailed object" hereafter) and the tip of the driver blade at the lower dead center from which a nail is ejected, namely the distance between the nailed object and driver blade in order to drive a nail into the nailed object in the manner that the head of the nail driven by the nailing tool is flush with the surface of the nailed object. For example, the driving machine disclosed in Patent Literature 1 below comprises a driving depth adjusting device in which the part of the push lever that makes contact with the driving machine body is threaded in the body using a screw. The operator shifts the knob in which the screw is housed in the axial direction of the screw to adjust the upper dead center of the push lever. In this way, the distance between the tip of the push lever and the tip of the driver blade at the lower dead center is adjusted.

Patent Literature 1: Unexamined Japanese Patent Application KOKAI Publication No. 2003-136429

The pressure of the compressed air supplied to the nailing machine is generally set for a relatively wide range of values to cover a wide range of applications. When the operator adjusts the nail driving force using the adjusting device described in the Patent Literature 1, he/she has to do a test driving to adjust the position of the push lever tip. In other words, a problem is that this adjusting operation increases the number of steps.

SUMMARY OF INVENTION

The present invention is invented in view of the above problem and the purpose of the present invention is to provide a pneumatic driving machine having an ability of automatically controlling the driving force.

In order to achieve the above purpose, the pneumatic driving machine according to the first aspect of the present invention is characterized by comprising:

a housing;

a cylinder provided in the housing;

a piston reciprocating between a first position and a second position within the cylinder and dividing the interior of the cylinder into an above-the-piston chamber and a below-the-piston chamber;

an accumulator accumulating compressed air for moving the piston from the first position to the second position;

a main valve sending the compressed air accumulated in the accumulator to the above-the-piston chamber to move the piston from the first position to the second position upon operation of a trigger;

a return air chamber communicating with the above-the-piston chamber and the below-the-piston chamber while the piston is positioned at the second position, and accumulating compressed air supplied from the above-the-piston chamber when the piston moves from the first position to the second position;

a push lever connected to the housing via a first resilient member and biased by the first resilient member to abut on the nailed object;

a driver blade fixed to the piston and hitting and driving a fastener into a workpiece; and a driving force control means controlling the driving force of the driver blade for hitting the fastener based on the moving distance of the housing relative to the push lever as a result of receiving a reaction force from the nailed object upon driving the fastener.

Possibly, the driving force control means controls the pressure in the return air chamber based on the moving distance of the housing relative to the push lever in the direction opposite to the driving direction as a result of receiving a reaction force from the nailed object upon driving the fastener.

Possibly, the driving force control means increases the pressure in the return air chamber as the moving distance of the housing relative to the push lever is smaller.

Possibly, the driving force control means comprises a control valve allowing or blocking entry of compressed air into the return air chamber from the above-the-piston chamber via a check valve based on the moving distance of the housing relative to the push lever.

Possibly, the return air chamber communicates with the above-the-piston chamber via a control passage extending in the driving direction and having a reduced-diameter part having a passage diameter smaller than the other part;

the control valve comprises:

a valve member sliding within the control passage in the driving direction and provided with one end having a diameter larger than the passage diameter of the reduced-diameter part and closing the control passage when engaging with the reduced-diameter part, and a second resilient member biasing the one end of the valve member in the driving direction so that the one end engages with the reduced-diameter part; and the push lever pushes the other end of the valve member in the direction opposite to the driving direction against the biasing force of the resilient member so that the one end of the valve member disengages from the reduced-diameter part when the moving distance of the housing relative to the push lever is smaller than a predetermined distance.

Possibly, the driving force control means comprises a control valve controlling the resistance to entry of compressed air from the above-the-piston chamber based on the moving distance of the housing relative to the push lever.

Possibly, the return air chamber communicates with the above-the-piston chamber via a control passage extending in the driving direction and having a reduced-diameter part having a passage diameter smaller than the other part; and the control valve comprises:

a closing member placed in the control passage, having a diameter larger than the passage diameter of the reduced-diameter part, and closing the control passage when engaging with the reduced-diameter part, a second resilient member biasing the closing member in the direction opposite to the driving direction so that the closing member engages with the reduced-diameter part, a pin having one end abutting on the opposite end of the resilient member to the end abutting on the closing member so as to be biased in the driving direction, and a moving means moving the pin within the control passage in the driving direction based on the moving distance of the housing relative to the push lever.

Possibly, the moving means comprises a locker arm that has one end pushing the other end of the pin in the direction opposite to the driving direction and the other end abutting on a third resilient member fixed to the housing at one end so as to be biased in the driving direction and abutting on the push lever so as to be pushed in the direction opposite to the driving direction, and that is rotatable about a rotation axis positioned between the two ends.

Possibly, the return air chamber consists of a first return air chamber communicating with the above-the-piston chamber and below-the-piston chamber and a second return air chamber communicating with the first return air chamber via an air passage; and the driving force control means comprises a control valve controlling the opening/closing of the air passage based on the moving distance of the housing relative to the push lever.

Possibly, the air passage includes a control passage extending in the driving direction and having a reduced-diameter part having a passage diameter smaller than the other part;

the control valve comprises:

a valve member sliding within the control passage in the driving direction and provided with one end having a diameter larger than the passage diameter of the reduced-diameter part and closing the control passage when engaging with the reduced-diameter part, and a second resilient member having one end fixed to the housing and the other end abutting on the valve member to bias the valve member in the driving direction; and the push lever pushes the other end of the valve member in the direction opposite to the driving direction against the biasing force of the second resilient member so that the one end of the valve member engages with the reduced-diameter part when the moving distance of the housing relative to the push lever is smaller than a predetermined distance.

The present invention provides a pneumatic driving machine having an ability of automatically controlling the driving force.

BEAST MODE FOR CARRYING OUT THE INVENTION (Embodiment 1)

A nailing machine 1 according to Embodiment 1 of the present invention will be described hereafter with reference to the drawings. For clarified explanation, the direction in which a fastener is ejected from the nailing machine 10 is defined as the ejection direction, and the ejection direction is termed downward and the direction opposite to it is termed upward in this embodiment.

Figure 1:
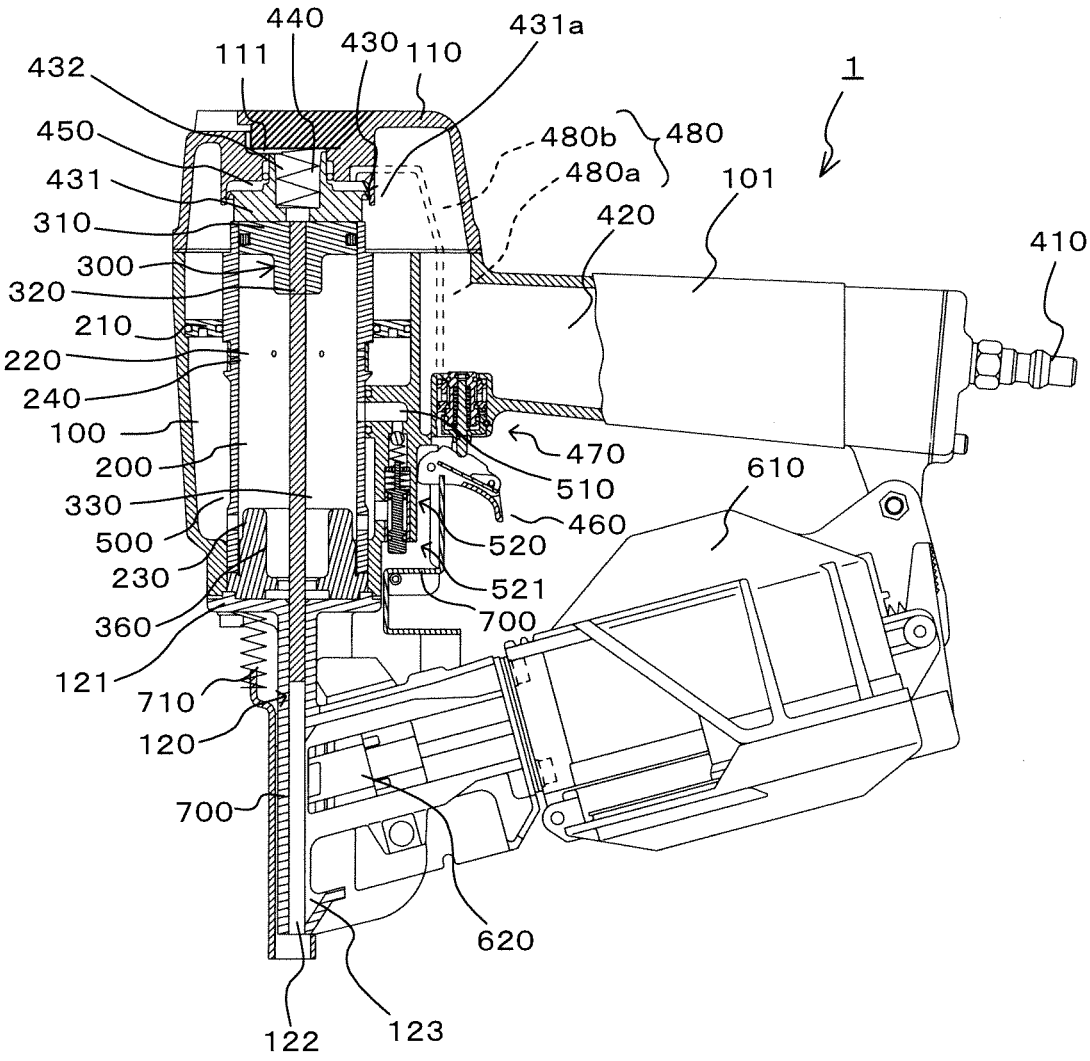
FIG. 1 is a cross-sectional view of the nailing machine according to Embodiment 1.

FIG. 1 is a lateral cross-sectional view of a nailing machine 1 of this embodiment of the present invention. The nailing machine 1 of this embodiment of the present invention mainly consists of a body (housing) 100, a cylinder 200 provided inside the body 100, and a piston 300 sliding within the cylinder 200. These parts will be described in detail hereafter.

The body 100 has the cylinder 200 therein. The body 100 has a holding part 101 extending in the direction nearly perpendicular to the driving direction. An exhaust cover 110 is hermetically fixed to the top of the body 100 by not-shown multiple bolts to cover the upper opening of the cylinder 200. A nose 120 is fixed to the bottom of the body 100 by not-shown multiple bolts to cover the lower opening of the cylinder 200. The exhaust cover 110 has an exhaust passage 111 allowing an above-the-piston chamber 340 within the cylinder 200, which will be described later, to communicate with the atmosphere.

The cylinder 200 has a nearly cylindrical form and supports the piston 300 slidably (reciprocating) on the inner surface thereof. A cylinder plate 210 in the form of a ring is interposed between the outer surface of the cylinder 200 and the inner surface of the body 100. The cylinder 200 has air holes 220 and 230 and an air passage 510, which will be described later.

Figure 4:
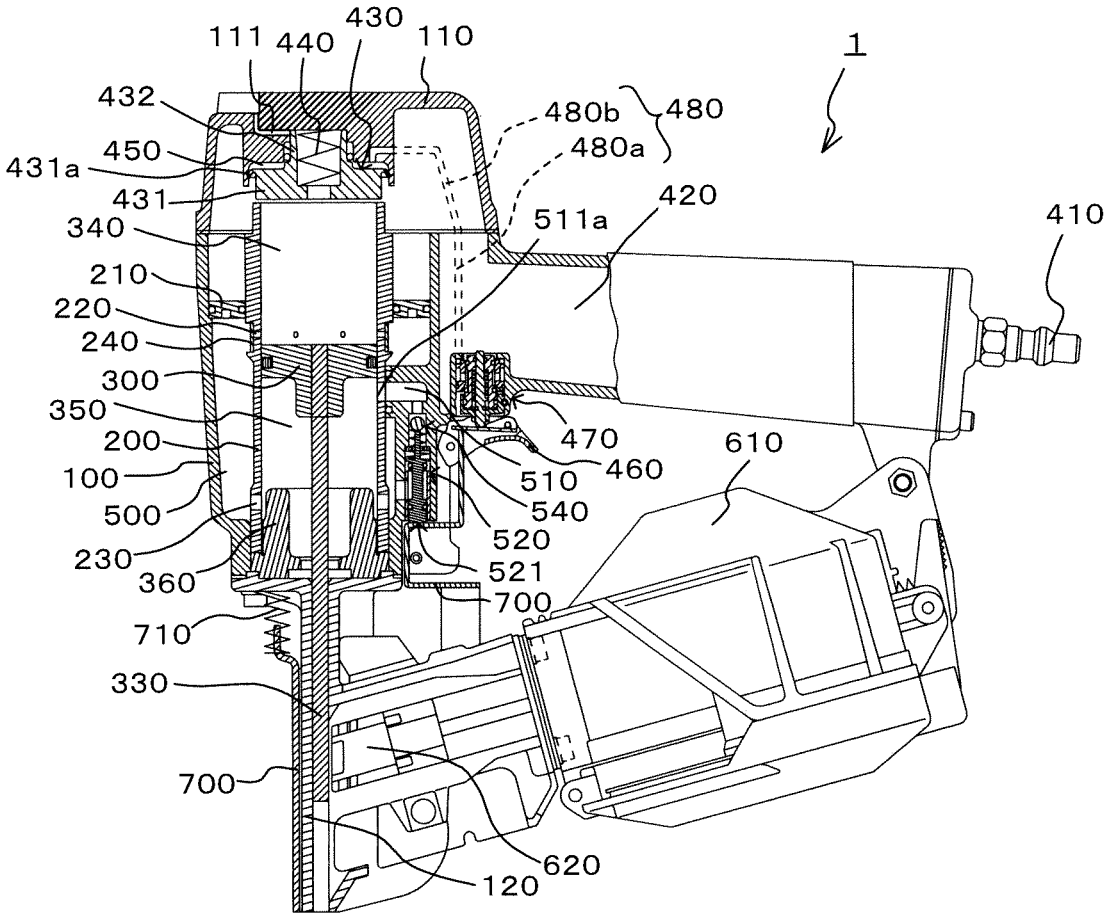
FIG. 4 is a cross sectional view showing the piston operation of the nailing machine according to Embodiment 1.

The piston 300 can slide (reciprocate) within the cylinder 200 in the nail driving direction. The piston 300 is formed by an integral piece consisting of a cylindrical large-diameter part 310 and a cylindrical small-diameter part 320 protruding downward from the large-diameter part 310. The upper end of a driver blade 330 in the form of a shaft is fitted in a through-hole formed in the center of the piston 300. The lower end of the driver blade 330 abuts on a nail upon driving. The piston 300 divides the interior of the cylinder 200 into an above-the-piston chamber 340 and a below-the-piston chamber 350 as shown in FIG. 4. A piston bumper 360 consisting of a resilient body such as rubber nearly in the shape of a tub having a through-hole in the center is provided at the lower end of the cylinder 200 to absorb shock upon downward movement of the piston 300.

The member supplying compressed air in the cylinder 200 will be described hereafter. As shown in FIG. 1, an air plug 410 connected to an air hose hooked to a not-shown air compressor for introducing compressed air into the nailing machine 1 is provided at the end of the holding part 101 of the body 100. An accumulator 420 accumulating the compressed air introduced through the air plug 410 is formed by the upper part of a cylindrical space enclosed by the cylinder 200, body 100, and cylinder plate 210. A cylindrical return air chamber 500, which will be described later, is formed by the lower part of it.

A head valve 430 serving to introduce or block the compressed air from the accumulator 420 into the cylinder 200 is provided above the cylinder 200. The head valve 430 is formed by an integral piece consisting of a nearly cylindrical lower member 431 having a through-hole in the center and a tubular upper member 432 provided above the lower member 431 coaxially with it. A flange 431*a* having a diameter larger than the other part so as to make contact with the exhaust cover 110 is formed at the upper end of the lower member 431 of the head valve 430. The underside of the flange 431*a* is normally pushed upward by the compressed air accumulated in the accumulator 420. On the other hand, the head valve 430 is biased downward (in the direction to abut on the cylinder 200) by a head valve spring 440 placed inside the upper member 432 and normally (in the driving standby state) positioned at the lower dead center. An above-the-head valve chamber 460 is formed between the top surface of the lower member 431 of the head valve 430 and the exhaust cover 110. The head valve 306 moves between the upper dead center and lower dead center described below depending on the pressure in an above-the-head valve chamber 450 described later, which the top surface of the lower member 431 of the head valve 430 receives, and the differential pressure between the pressure from the resilience of the head valve spring 440 and the pressure in the accumulator 420, which the underside of the flange 431*a* of the head valve 430 receives.

As shown in FIG. 1, when the head valve 430 is positioned at the lower dead center, the lower surface of the head valve 430 abuts on the top surface of the cylinder 200 to block entry of the compressed air in the accumulator 420 into the cylinder 200. Meanwhile, the upper member 432 of the head valve 430 opens the opening of the exhaust passage 111 of the exhaust cover 110 to allow the interior of the cylinder 200 to communicate with the atmosphere.

Figure 2:
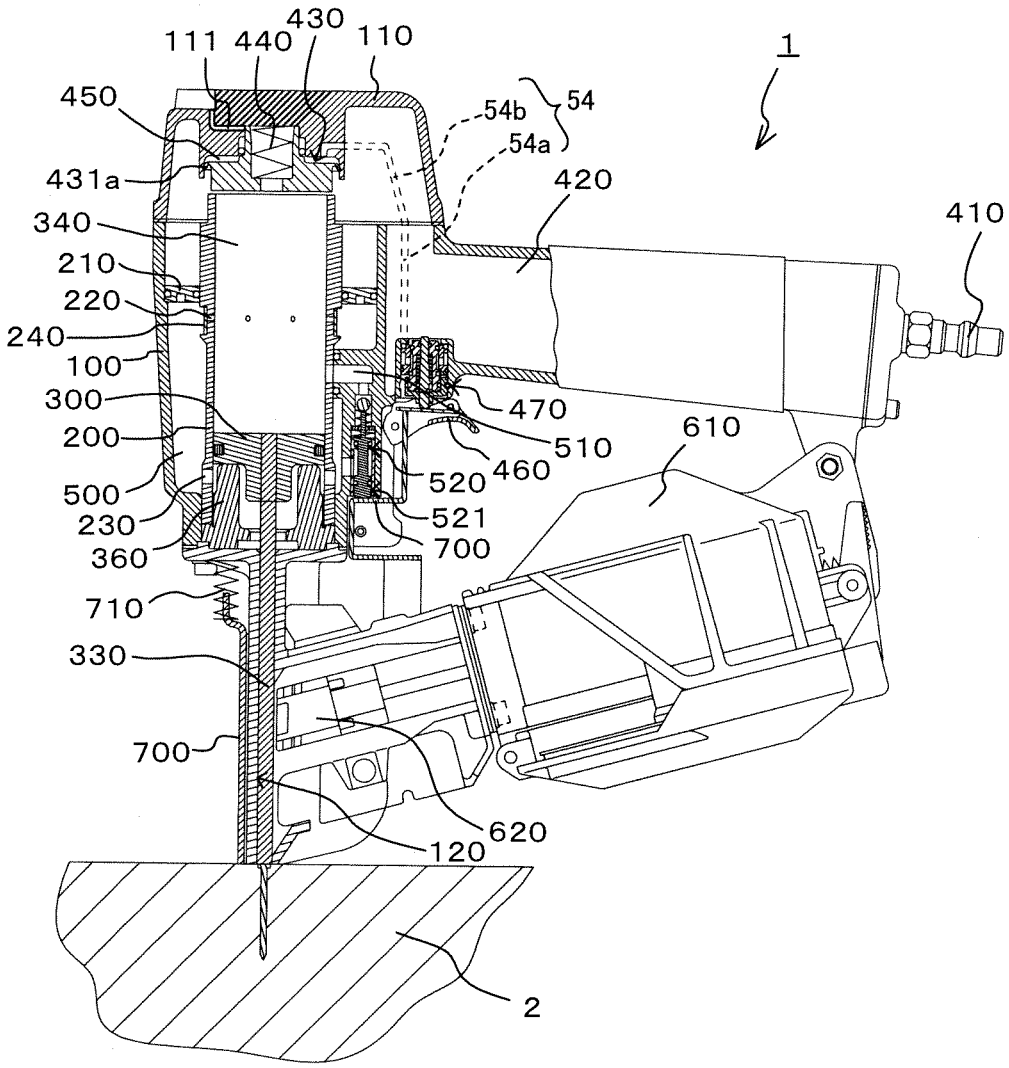
FIG. 2 is a cross-sectional view of the nailing machine according to Embodiment 1 during the driving operation.

Furthermore, as shown in FIG. 2, when the head valve 430 is positioned at the upper dead center, the lower surface of the head valve 430 is spaced from the top surface of the cylinder 200, allowing the compressed air in the accumulator 420 to enter the cylinder 200. Furthermore, the upper member 432 of the head valve 430 closes the opening of the exhaust passage 111 of the exhaust cover 110 to prevent the compressed air from escaping into the atmosphere.

Furthermore, the body 100 is provided with a trigger 460 and a trigger valve 470 for initiating the driving of the nailing machine 1 in the driving standby state as shown in FIG. 1 and then returning to the driving standby state.

The trigger 460 is rotatably supported by the body 100 and has a plate-like trigger arm 461 rotatably supported at one end. The other end of the trigger arm 461 abuts on the upper end of a push lever 700, which will be described later, when the push lever 700 is positioned at the upper dead center. Therefore, when the trigger 460 is pressed upward while the push lever 700 is shifted upward in relation to the body 100, the trigger arm 461 pushes up the plunger 471 of a trigger valve 470, which will be described later.

Figure 3:
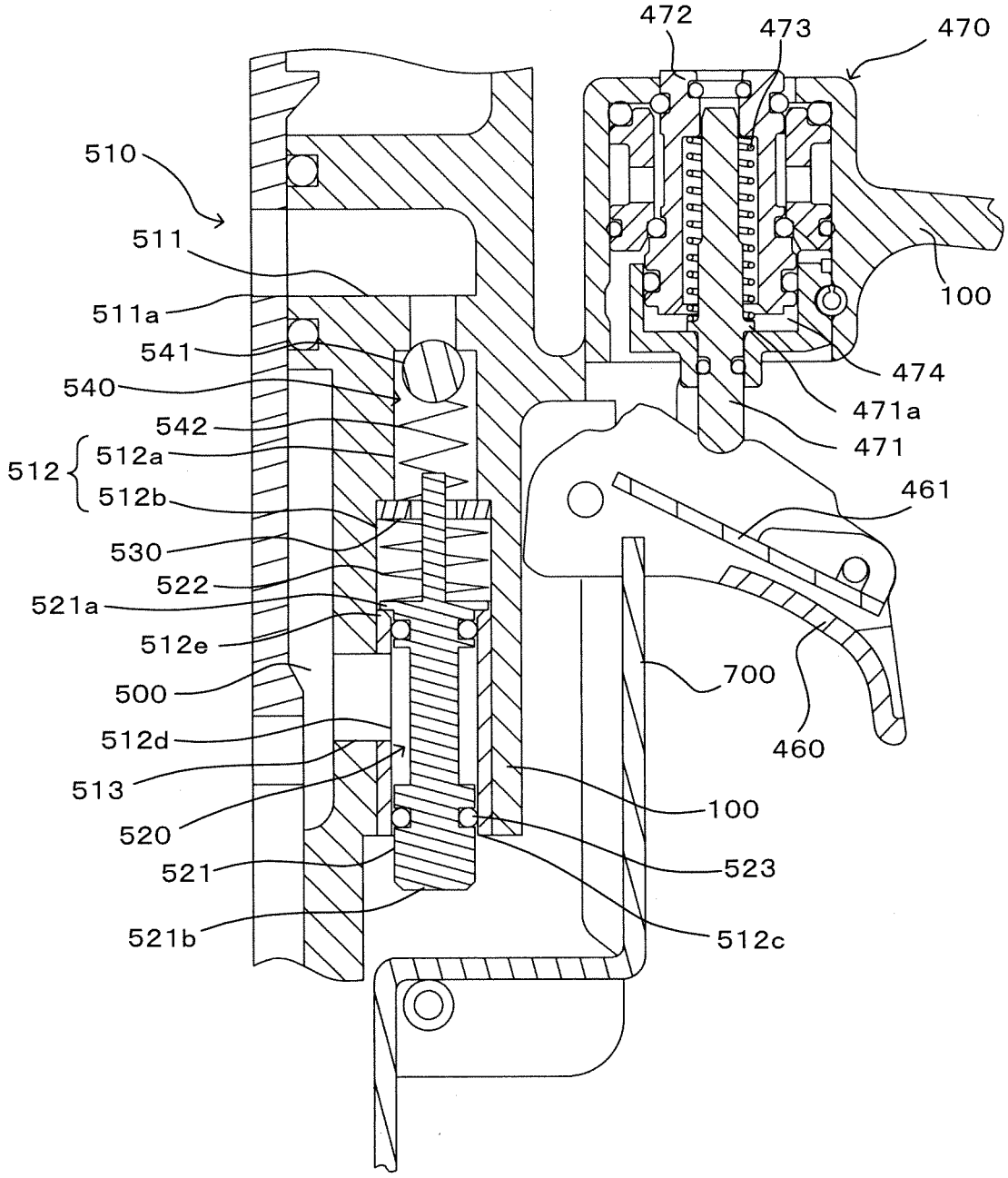
FIG. 3 is a cross-sectional view of the core part in FIG. 1.

The trigger valve 470 serves to change the position of the head valve 430 by supplying compressed air into the above-the-head valve chamber 450 or discharging compressed air from the above-the-head valve chamber 450. The trigger valve 470 is, as shown in FIG. 3, placed in the body 100 and mainly consists of a plunger 471 in the form of a shaft having a flange 471*a* having a diameter larger than the other part, a nearly cylindrical valve piston 472 surrounding the plunger 471, and a spring 473 abutting on the flange 471*a* of the plunger 471 for biasing it downward. When the plunger 471 is positioned at the lower dead center, the air tightness between the flange 471*a* and body 100 is maintained and the compressed air in the below-the-valve piston chamber 474 is supplied to the above-the-head valve chamber 450. On the other hand, when the plunger 471 is positioned at the upper dead center against the biasing force of the spring 473, the air tightness between the flange 471*a* and body 100 is broken and the compressed air in the below-the-valve piston chamber 474 is released into the atmosphere.

The member ejecting nails will be described hereafter. The member ejecting nails consists of a piston 300 sliding in the nail driving direction by way of compressed air, a driver blade 330 fixed to the piston 300, and a nose 120 guiding the nail to a desired driving point.

The nose 120 serves to guide the nail and driver blade 330 so that the driver blade 330 appropriately contacts the nail and drives it into a desired point on the nailed object 2. The nose 120 consists of a disk-shaped connection part 121 connected to the opening at the lower end of the body 100 and a tubular part 122 extending downward from the center of the connection part 121. Furthermore, the nose 120 has an ejection passage 123 formed through the center of the connection part 121 and tubular part 122. A magazine 610 housing multiple nails is mounted on the tubular part 122 of the nose 120. Nails are sequentially supplied to the ejection passage 123 in the nose 120 from the magazine 610 by a feeder 620 that can reciprocate by way of compressed air and resilient members.

A vertically slidable push lever 700 is provided along the outer surface of the nose 120. One end of the push lever 700 is connected to a spring 710 (compression spring) producing a biasing force in the nail driving direction. The push lever 700 is connected to the body 100 via the spring 710. The lower end of the push lever 700 protrudes from the lower end of the nose 120 in the driving standby state as shown in FIG. 1. On the other hand, receiving a reaction force from the nailed object 2, the push lever 700 moves upward relatively to the body 100 and nose 120 against the biasing force of the spring 710 during the driving operation on the nailed object 2 in which the body 100 is pressed against the nailed object 2 as shown in FIG. 2.

The driver blade 330 has a cylindrical column form and is integrally fixed to the piston 300 at the upper end. The driver blade 330 slides within the ejection passage 123 of the nose 120 to give the nail a driving force.

The structure for returning the piston 300 to the upper position in the cylinder 200 after the nail is driven will be described hereafter. The return air chamber 500 serves to return the piston 300 that has moved to the lower dead center after driving the nail to the initial position or upper dead center (the first position). The return air chamber 500 is formed by the lower part of a cylindrical space enclosed by the cylinder 200, body 100, and cylinder plate 210. The return air chamber 500 communicates with the cylinder 200 via air holes 220 and 230 each formed in the sidewall of the cylinder 200 in the circumferential direction. The air hole 220 is foamed above the lower dead center, namely the point where the piston 300 abuts on the piston bumper 360 (the second position). The air hole 230 is formed below the point where the piston 300 abuts on the piston bumper 360. The air hole 220 is provided with a check valve 240 allowing one-way flow of compressed air from the above-the-piston chamber 340 to the return air chamber 500. When the piston 300 moves from the upper dead center to the lower dead center, the compressed air enters and accumulates in the return air chamber 500 via the air hole 220 having the check valve 240.

The driving force control means controlling the driving force by controlling the pressure in the return air chamber 500 will be described hereafter. The driving force control means of this embodiment consists of, as shown in FIG. 3, an air passage 510 and a control valve 520 controlling the opening/closing of the air passage 510.

The air passage 510 is a passage allowing communication between the cylinder 200 and return air chamber 500. The air passage 510 consists of an influx passage 511, a control passage 512, and an outflux passage 513.

The influx passage 511 is a passage guiding the compressed air in the cylinder 200 to the control passage 512. The influx passage 511 opens to the peripheral surface of the cylinder 200 at one end, where an opening 511*a* is formed, and extends outward in the radial direction of the cylinder 200 from the opening 511*a*. The other end of the influx passage 511 is connected to one end the control passage 512. The opening 511*a* of the influx passage 511 is formed in the peripheral surface of the above-the-piston chamber 340 when the piston 300 is positioned at the second position.

The control passage 512 allows or blocks entry of compressed air coming through the influx passage 511 into the return air chamber 500. The control passage 512 extends in the driving direction, namely in the sliding direction of the piston. The control passage 512 consists of a first control passage 512*a* and a second control passage 512*b*. A partition 530 having a through-hole allowing entry of the compressed air is placed at the connection part between the first and second control passages 512*a* and 512*b*.

The first control passage 512*a* is connected to the influx passage 511 at one end and to the second control passage 512*b* at the other end. A check valve 540 allowing only the entry of compressed air from the influx passage 511 and blocking entry of compressed air into the influx passage 511 from the first control passage 512*a* is provided at the one end of the first control passage 512*a* that is connected to the influx passage 511. The check valve 540 consists of a closing member 541 closing the opening of the first control passage 512*a* that makes connection to the influx passage 511, and a spring 542 that is a resilient member biasing the closing member 541 in the direction opposite to the driving direction, namely in the direction the closing member 541 closes the opening. Therefore, the compressed air coming from the influx passage 511 is allowed to enter the first control passage 512*a* by pushing down the closing member 541 in the driving direction against the biasing force of the spring 542. However, the compressed air in the first control passage 512*a* cannot enter the influx passage 511 because the closing member 541 closes the opening.

The second control passage 512*b* is connected to the first control passage 512*a* at one end and has at the other end an opening 512*c* opening in the driving direction from the body 100. Furthermore, the second control passage 512*a* has an opening 512*d* opening inward in the radial direction of the cylinder 200, where it is connected to the outflux passage 513. Furthermore, a reduced-diameter part 512*e* protruding inward in the radial direction of the second control passage 512*b* and having a passage diameter smaller than the other part is formed along the peripheral surface of the second control passage 512*b* between the connection part to the first control passage 512*a* and the opening where it is connected to the outflux passage 513. A control valve 520 allowing or blocking entry of compressed air coming from the above-the-piston chamber 340 into the return air chamber 500 via the influx passage 511 and first control passage 512*a* based on the moving distance of the body 100 relative to the push lever 700 is provided in the second control passage 512*b*.

The control valve 520 consists of a valve member 521 sliding within the second control passage 512*b* and a spring 522 that is a resilient member biasing the valve member 521 in the driving direction. The valve member 521 has at one end a flange 521*a* protruding outward in the radial direction of the second control passage 521*b* from the other part of the valve member 521. The flange 521*a* has a diameter larger than the passage diameter of the reduced-diameter part 512*e* of the second control passage 512*b* and engages with the reduced-diameter part 512*e* to close the second control passage 512*b*. Furthermore, the valve member 521 has at the other end an abutting part 521*b* protruding outside the body 100 through the opening 512*c* of the second control passage 512*b* and abutting on the push lever 700. The abutting part 521*b* is provided with a sealing member 523 to prevent leakage of compressed air from the opening 512*c*. The spring 522 abuts on the flange 521*a* at one end and abuts on the partition 530 at the other end. Then, the spring 522 biases the flange 521*a* of the valve member 521 in the driving direction, namely in the direction the flange 521*a* engages with the reduced-diameter part 25512*e*. Therefore, when the push lever 700 does not abut on the abutting part 521*b*, the biasing force of the spring 522 causes the flange 521*a* to engage with the reduced-diameter part 512*e* and close the second control passage 512*b*, whereby the control valve 520 blocks entry of compressed air from the first control passage 511. When the push lever 700 abuts on the abutting part 521*b* and pushes it upward, the flange 521*a* of the valve member 521 moves upward against the biasing force of the spring 522 and disengages from the reduced-diameter part 512*e*. Therefore, the control valve 520 allows entry of compressed air from the first control passage 511.

The outflux passage 513 is a passage guiding the compressed air in the control passage 512 to the return air chamber 500. The outflux passage 513 opens to the peripheral surface of the second control passage 512*b* at one end, where an opening 512*d* is formed, and extends inward in the radial direction of the cylinder 200 from the opening 512*d*.

The operational behavior of the nailing machine 1 having the above structure will be described hereafter.

First, the nailing machine 1 of this embodiment in the driving standby state will be described. As shown in FIG. 1, first, the air plug 410 of the nailing machine 1 is connected to an air hose hooked to a not-shown compressor that supplies compressed air as power source of the nailing machine 1. Then, the compressed air is supplied into the accumulator 420 provided in the body 100 of the nailing machine 1 via the air plug 410. The accumulated compressed air is partly supplied to the below-the-valve piston chamber 474 shown in FIG. 3 so that the plunger 471 is pushed down to the lower dead center. Meanwhile, the compressed air pushes up the valve piston 472 and enters the above-the-head valve chamber 450 via the gap created by the raised valve piston 474, body 100, and air passages 480*a* and 480*b* shown in FIG. 1. The compressed air supplied in the above-the-head valve chamber 450 pushes down the head valve 430 so that the head valve 430 and cylinder 200 make close contact with each other, whereby the compressed air does not enter the cylinder 200. In this way, the piston 300 and driver blade 330 remain in the driving standby state in which they stand still at the upper dead center (the first position).

The behavior of the nailing machine 1 of this embodiment during the driving operation will be described hereafter. As shown in FIG. 2, when the operator presses the push lever 700 against the nailed object 2, the top of the push lever 700 abuts on the abutting part 521*b* of the valve member 521 provided in the control passage 512 shown in FIG. 3 to move the valve member 521 to the upper dead center. Then, the flange 521*a* of the valve member 521 disengages from the reduced-diameter part 512*e* to open the air passage 510.

Then, as shown in FIG. 2, the operator pulls the trigger 460 while pressing the push lever 700 against the nailed object 2. Consequently, the plunger 471 of the trigger valve 470 shown in FIG. 3 is pushed up to the upper dead center so that the compressed air in the below-the-valve piston chamber 474 is discharged. Furthermore, the difference in pressure between the air passage 480*a* and below-the-valve piston chamber 474 serves to push down the valve piston 472. Then, the compressed air in the above-the-head valve chamber 450 is discharged into the atmosphere via the air passage 480*b* of the exhaust cover 110 and the air passage 480*a* provided in the body 100. After the compressed air in the above-the-head valve chamber 450 is discharged, the pressure of the compressed air in the accumulator 420 serves to push up the head valve 430 to make a gap between the head valve 430 and cylinder 200. The compressed air enters the above-the-piston chamber 340 within the cylinder 200 through the gap. With the compressed air entering the above-the-piston chamber 340, the piston 300 and driver blade 330 quickly move to the lower dead center. Consequently, the tip of the driver blade 330 hits the nail and drives it into the nailed object 2. Here, the piston 300 bumps against the piston bumper 360 at the lower dead center and the deformed piston bumper 360 absorbs excess energy.

Meanwhile, as the piston 300 moves from the upper dead center to the lower dead center, the air in the below-the-piston chamber 350 enters the return air chamber 500 via the air hole 230 and air passage 510. Furthermore, after the piston 300 passes the air hole 220 as shown in FIG.4, the compressed air in the above-the-piston chamber 340 partly enters the return air chamber 500 via the air hole 220. Furthermore, after the piston 300 passes the opening 511*a* of the air passage 510, the compressed air in the above-the-piston chamber 340 partly enters the return air chamber 500 via the air passage 510. Here, during the driving operation. the pressures in the accumulator 420 and above-the-piston chamber 340 are nearly equal and the pressure in the return air chamber 500 is lower than the pressure in the above-the-piston chamber 340. This is because the compressed air enters the return air chamber 500 from the above-the-piston chamber 340 via the air hole 220 and air passage 510 where the check valves 240 and 540 cause resistance to entry.

The restoring action of the nailing machine 1 of this embodiment after driving the nail will be described hereafter. When the operator returns the trigger to the initial position or releases the push lever 700 from the nailed object 2, the plunger 471 of the trigger valve 470 shown in FIG. 3 returns to the lower dead center. Then, the compressed air in the accumulator 420 enters the trigger valve 470 and further enters the above-the-head valve chamber 450 via the air passages 480*a* and 480*b* shown in FIG. 2. The pressure of the compressed air in the above-the-head valve chamber 450 serves to return the head valve 430 to the lower dead center as shown in FIG. 1. Then, the lower surface of the head valve 430 abuts on the top surface of the cylinder 200 to block entry of compressed air into the above-the-piston chamber 340 from the accumulator 420. Meanwhile, when the head valve 430 is lowered to the lower dead center, the opening of the exhaust passage 111 provided in the exhaust cover 110 is opened, allowing the above-the-piston chamber 340 to communicate with the atmosphere. Therefore, the pressure in the below-the-piston chamber 350, namely the pressure in the return air chamber 500 where the compressed air is accumulated becomes higher than the pressure in the above-the-piston chamber 340. Then, the differential pressure between the below-the-piston chamber 350 and above-the-piston chamber 340 serves to quickly raise the piston 300 within the cylinder 200 toward the upper dead center together with the driver blade 330 and return it to the initial position (the first position). Here, the check valve 540 in the air passage 510 prevents the compressed air in the return air chamber 500 from entering the above-the-piston chamber 340 via the air passage 510.

The driving force control by the driving force control means of the nailing machine 1 of this embodiment will be described hereafter.

Generally, the nailing machine receives a small reaction force from the nailed object when the pressure of compressed air accumulated in the accumulator is high, when the nailed object is soft, or when the nail to be driven is thin or short. Therefore, in such cases, the upward movement of the nailing machine as a result of the reaction force from the nailed object is small and the nail is driven deep into the nailed object. Conversely, the nailing machine receives a large reaction force from the nailed object when the pressure of compressed air accumulated in the accumulator is low, when the nailed object is hard, or when the nail to be driven is thick or long. Therefore, in such cases, the upward movement of the nailing machine as a result of the reaction force from the nailed object is large and the nail is driven shallowly into the nailed object. As just stated, the nail is driven into the nailed object to different depths depending on the nailing machine, nail, nailed object, or compressed air used. The driving force control means of the nailing machine 1 of this embodiment detects the magnitude of reaction force the nailing machine 1 receives from the nailed object 2 as the distance of the nailing machine 1 moving upward from the nailed object 2 and controls the driving force based on the distance.

First, the behavior of the nailing machine 1 in the case wherein the nailing machine 1 receives a small reaction force from the nailed object 2 will be described. While the operator drives a nail, the push lever 700 stays abutting on the nailed object 2 because of the biasing of the spring 710. When the nailed object 2 produces a small reaction force, as shown in FIG. 2, the nose 120 continues to abut on the nailed object 2 or slightly moves upward. Then, the push lever 700 continues to push the valve member 521 upward; therefore, the air passage 510 stays open. Hence, the compressed air in the above-the-piston chamber 340 enters the return air chamber 500 via the air passage 510. Then, the pressure in the above-the-piston chamber 340 is decreased and the pressure in the return air chamber 500 is increased. Furthermore, the compressed air entering the below-the-piston chamber 350 from the return air chamber 500 via the air hole 230 serves as air damper, reducing the driving force of the driver blade 330. In this way, the nail is not driven excessively deep into the nailed object 2 even in the case wherein the nailing machine 1 receives a small reaction force from the nailed object 2.

Figure 5:
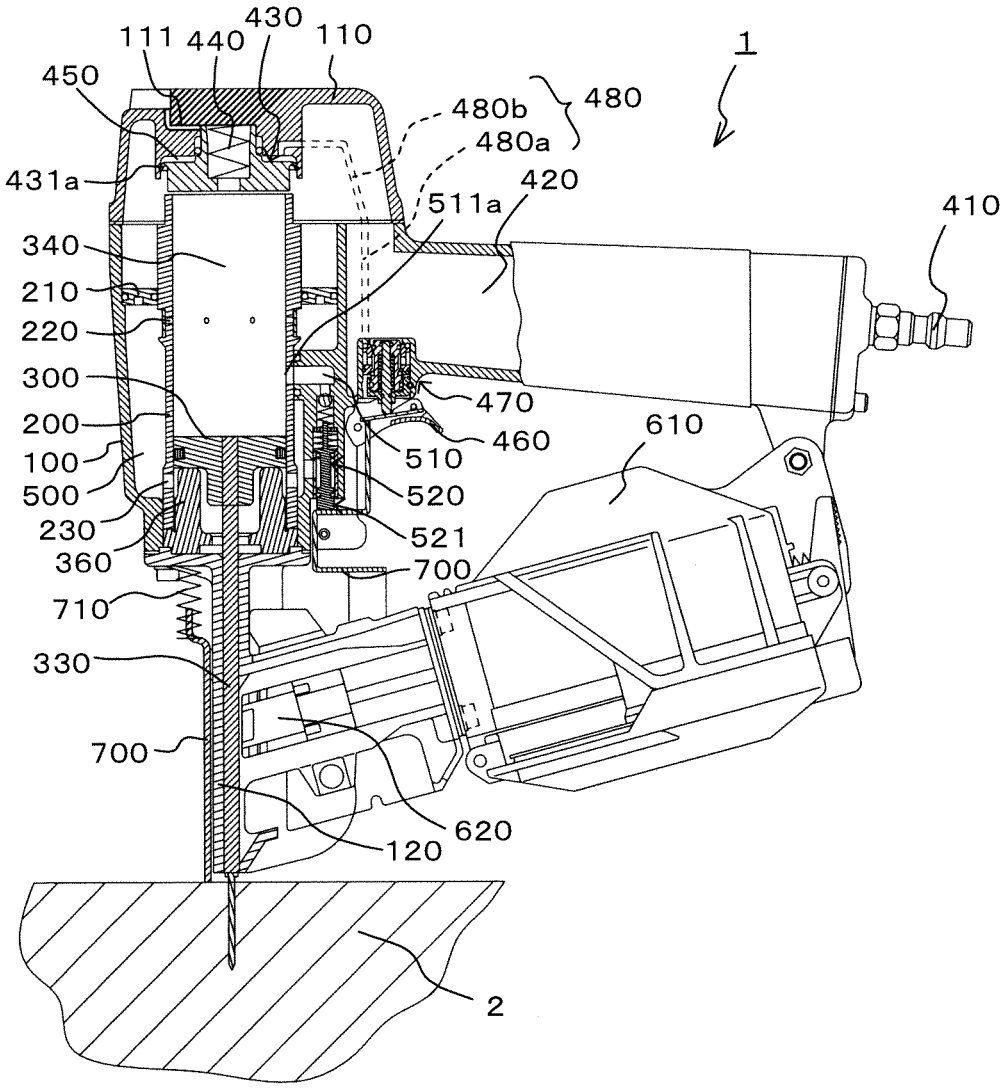
FIG. 5 is a cross-sectional view of the nailing machine according to Embodiment 1 during the driving operation.

The behavior of the nailing machine 1 in the case wherein the nailing machine 1 receives a large reaction force from the nailed object 2 will be described hereafter. When the nailed object 2 produces a large reaction force, as shown in FIG. 5, the reaction force from the nailed object 2 causes the nose 120 to move away and further upward from the nailed object 2 compared to the case of a small reaction force. Since the push lever 700 continues to abut on the nailed object 2 because of the biasing force of the spring 710, the body 100 moves upward relatively to the push lever 700. Here, the valve member 521 is less pushed by the push lever 700 and moves downward relatively to the body 100 because of the biasing force of the spring 522. Then, the flange 521*a* of the valve member 521 engages with the reduced-diameter part 512*e* to close the air passage 510. Consequently, the compressed air is not allowed to enter the return air chamber 500 from the above-the-piston chamber 340 via the air passage 510. Therefore, the driving force of the driver blade 330 is not reduced by the compressed air entering the below-the-piston chamber 350 from the above-the-piston chamber 340 via the air passage 510 and return air chamber 500 and serving as air damper as in the case of a small reaction force. In this way, the nailing machine 1 can drive a nail into the nailed object 2 with its maximum driving force in the case wherein the nailing machine 1 receives a large reaction force from the nailed object 2.

As described above, the nailing machine 1 of this embodiment of the present invention reduces the driving force of the driver blade 330 to prevent the nail from being driven excessively deep into the nailed object 2 in the case wherein the nailing machine 1 receives a small reaction force from the nailed object 2 during the driving operation. Furthermore, the compressed air in the below-the-piston chamber 350 serves as air damper and reduces the driving energy of the piston 300 from the beginning to end (when the piton 300 bumps against the piston bumper 360) of driving. Therefore, the shock caused by excess energy of the piston 300 on the piston bumper 360 can be reduced, improving the durability of the piston bumper 360, namely the durability of the nailing machine 1.

Furthermore, the nailing machine 1 of this embodiment of the present invention detects the moving distance of the body 100 relative to the nailed object 2 as a result of the reaction force the nailing machine 1 receives from the nailed object 2 to control the driving force. Therefore, there is no need of test driving and manual control of the driving force, improving the working efficiency.

(Embodiment 2)

A nailing machine 1 according to Embodiment 2 of the present invention will be described hereafter with reference to the drawings. The driving force control means of the nailing machine 1 of Embodiment 1 controls the opening/closing of the air passage 510 based on the moving distance of the body 100 relative to the push lever 700 as a result of the reaction force from the nailed object 2 so as to control the pressure in the return air chamber 500. On the other hand, the driving force control means of the nailing machine 1 of this embodiment changes the resistance to entry of compressed air into the return air chamber 500 from the above-the-piston chamber 340 based on the moving distance of the body 100 relative to the push lever 700 as a result of the reaction force from the nailed object 2 so as to control the pressure in the return air chamber 500. The driving force control means of the nailing machine 1 of this embodiment will be described in detail hereafter. The same structures as in the nailing machine 1 of Embodiment 1 are referred to by the same reference numbers and their explanation will be omitted.

Figure 6:
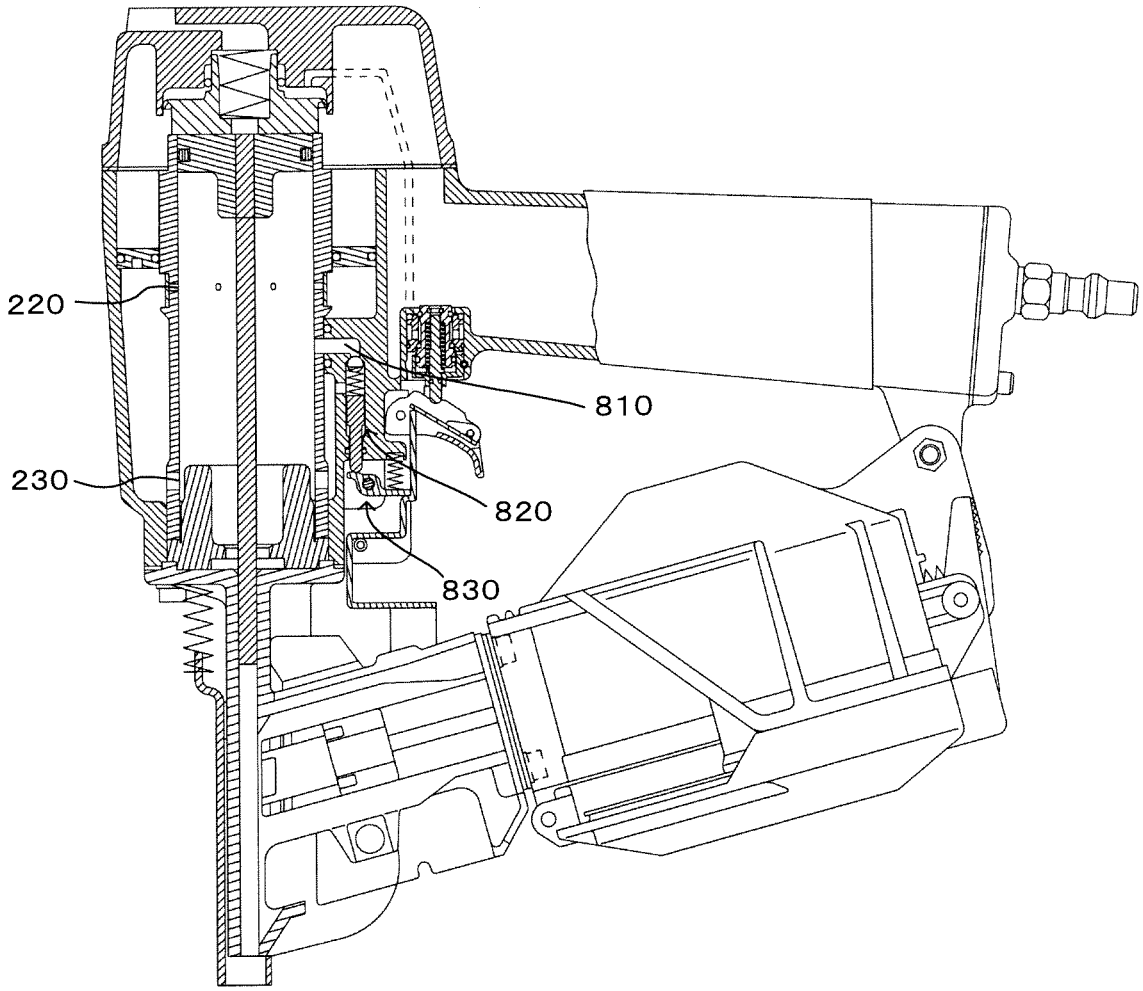
FIG. 6 is a cross-sectional view of the nailing machine according to Embodiment 2.

FIG. 6 is a cross-sectional view of the nailing machine 1 of this embodiment of the present invention. The driving force control means of the nailing machine 1 of this embodiment of the present invention comprises an air passage 810, a control valve 820 controlling the resistance to entry of compressed air into the return air chamber 500 from the above-the-piston chamber 340 via the air passage 810, and a detection part 830 detecting the movement of the push lever 700 relative to the body 100.

Figure 7:
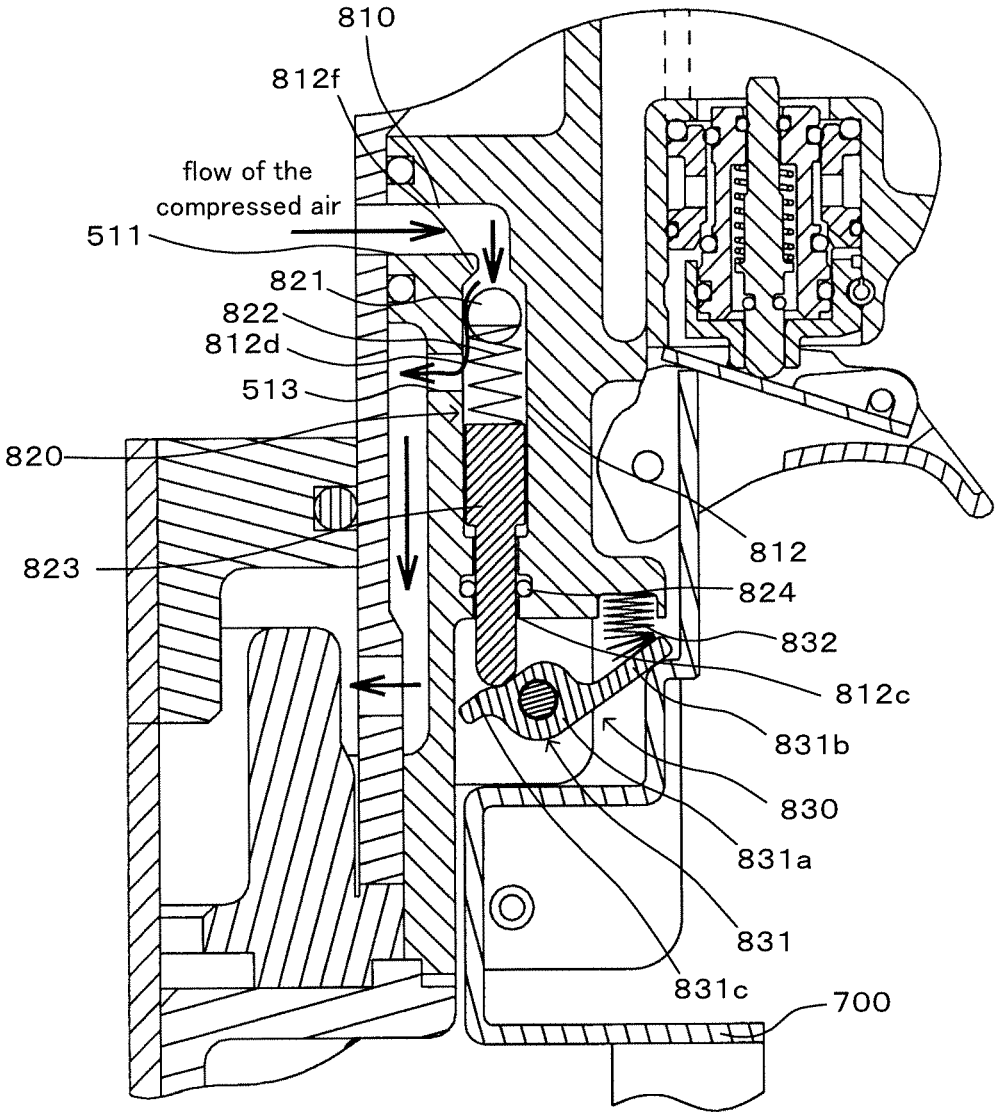
FIG. 7 is a cross-sectional view of the core part in FIG. 6.

The air passage 810 is a passage allowing communication between the cylinder 200 and return air chamber 500. As shown in FIG. 7, the air passage 810 consists of a influx passage 511, a control passage 812, and an outflux passage 513. Here, the influx passage 511 and outflux passage 513 have the same structures as those of Embodiment 1 and their explanation is omitted.

The control passage 812 is a passage for controlling the resistance to entry of compressed air coming through the influx passage 511 into the return air chamber 500. The control passage 812 extends in the driving direction, namely in the sliding direction of the piston. The control passage 812 is connected to the influx passage 511 at one end and has at the other end an opening 812*c* opening in the driving direction from the body 100. The control passage 812 also has an opening 812*d* opening inward in the radial direction of the cylinder 200 and is connected to the outflux passage 513 via the opening 812*d*.

The control valve 820 allows only the entry of compressed air from the influx passage 511 and blocks the entry of compressed air into the influx passage 511 from the control passage 812. The control valve 820 also controls the resistance to entry of compressed air coming from the influx passage 511, in other words controls the difficulty level of entry of compressed air into the control passage 812 from the influx passage 511. The control valve 820 consists of a closing member 821, a spring 822, and a pin 823.

The closing member 821 is a spherical member formed at the connection part between the influx passage 511 and control passage 812 and having a diameter larger than the opening 812*f*. The closing member 821 is placed in the control passage 812 and biased upward by the spring 822. The closing member 821 engages with the opening 812*f* by way of the biasing force of the spring 822 to close the control passage 812.

The spring 822 is a member biasing the closing member 821 upward, namely to close the opening 812*f*. The spring 822 abuts on the closing member 821 at one end and abuts on one end of the pin 823 at the other end.

The pin 823 is a member sliding within the control passage 812 based on the moving rate of the push lever 700 relative to the body 100 that is detected by the detection part 830. The pin 823 abuts on the spring 822 at one end. The other end of the pin 823 protrudes outside the body 100 through the opening 812*c* of the control passage 812 and abuts on one end of a locker arm 831 of the detection part 830, which will be described later. The pin 823 slides within the control passage 812 and changes the compression of the spring 822 as the locker arm 831 rotates. Furthermore, the pin 823 is provided with a sealing member 824 for preventing leakage of compressed air to the outside through the opening 812*c* of the control passage 812.

The detection part 830 serves to detect the movement of the push lever 700 relative to the body 100. The detection part 830 consists of a locker at in 831 and a spring 832.

The locker arm 831 consists of a body 831*a* having a rotation axis in the center, a first protrusion 831*b* protruding radially outward from the body 831*a*, and a second protrusion 831*c* protruding radially outward from a position on the body that is nearly opposite to the position where the first protrusion 831*b* protrudes. The underside of the first protrusion 831*b* abuts on the push lever 700 and the top surface abuts on one end of the spring 832. The top surface of the second protrusion 831*c* abuts on the end of the pin 823.

The spring 832 abuts on the body 100 at one end and abuts on the top surface of the first protrusion 831*b* of the locker arm 831 at the other end. The spring 832 biases the first protrusion 831*b* in the driving direction, namely downward.

The driving force control by the driving force control means of the nailing machine 1 of this embodiment will be described hereafter.

First, the behavior of the nailing machine 1 in the case wherein the nailing machine 1 receives a small reaction force from the nailed object 2 will be described. While the operator drives a nail, the push lever 700 stays abutting on the nailed object 2 because of the biasing of the spring 710. When the nailed object 2 produces a small reaction force, in the same manner as in Embodiment 1, as shown in FIG. 2, the nose 120 continues to abut on the nailed object 2 or slightly moves upward. Here, as shown in FIG. 7, the push lever 700 continues to push the first protrusion 831*b* of the locker arm 831 upward against the biasing force of the spring 832; therefore, the pin 823 abutting on the second protrusion 831*c* of the locker arm 831 is placed at the lower dead center by the biasing force of the spring 822. In this state, the spring 822 is least compressed and gives the closing member 821 the minimum biasing force. Therefore, the resistance to entry of compressed air into the return air chamber 500 from the above-the-piston chamber 340 via the air passage 810 is minimized. Then, the compressed air in the above-the-piston chamber 340 can easily enter the return air chamber 500 via the air passage 810. The pressure in the above-the-piston chamber 340 is decreased and the pressure in the return air chamber 500 is increased. Furthermore, the compressed air entering the below-the-piston chamber 350 from the return air chamber 500 via the air hole 230 serves as air damper and reduces the driving force of the driver blade 330. In this way, the nail is not driven excessively deep into the nailed object 2 even in the case wherein the nailing machine 1 receives a small reaction force from the nailed object 2.

Figure 8:
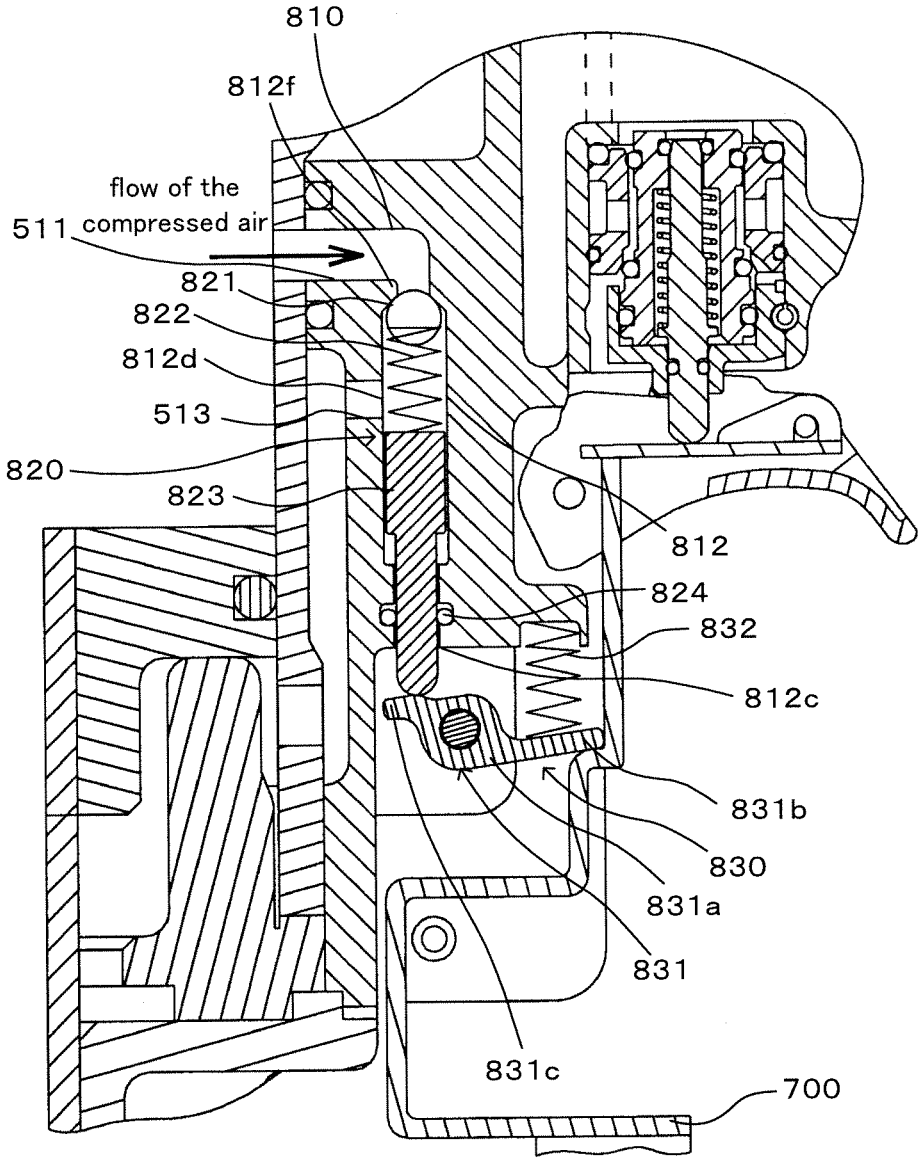
FIG. 8 is a cross-sectional view of the core part in FIG. 6.

The behavior of the nailing machine 1 in the case wherein the nailing machine 1 receives a large reaction force from the nailed object 2 will be described hereafter. When the nailed object 2 produces a large reaction force, in the same manner as in Embodiment 1, as shown in FIG. 5, the reaction force from the nailed object 2 causes the nose 120 to move away and further upward from the nailed object 2 compared to the case of a small reaction force. Since the push lever 700 continues to abut on the nailed object 2 because of the biasing force of the spring 710, the body 100 moves upward relatively to the push lever 700. Here, as shown in FIG. 8, the first protrusion 831*b* of the locker arm 831 rotates because of the biasing force of the spring 832 and the second protrusion 831*c* pushes the pin 823 upward against the biasing force of the spring 822. Pushed by the second protrusion 831*c*, the pin 823 moves within the control passage 812 upward. Then, the spring 822 is compressed by the pin 823 and biases the closing member 821 with a larger biasing force. Therefore, the resistance to entry of compressed air into the return air chamber 500 from the above-the-piston chamber 340 via the air passage 510 is increased compared to the case of a small reaction force. Then, the amount of compressed air entering the return air chamber 500 from the above-the-piston chamber 340 via the air passage 510 is reduced compared to the case of a small reaction force. The difference in pressure between the above-the-piston chamber 340 and the return air chamber 500, namely the below-the-piston chamber 350 is increased. Consequently, the compressed air that has entered the below-the-piston chamber 350 from the above-the-piston chamber 340 via the return air chamber 500 has less effect as air damper; therefore, the driving force of the driver blade 330 is not reduced. In this way, when the nailing machine 1 receives a large reaction force from the nailed object 2, the nailing machine 1 can drive a nail into the nailed object 2 with a large driving force compared to the case of a small reaction force.

As described above, the nailing machine 1 of this embodiment of the present invention reduces the driving force of the driver blade 330 to prevent the nail from being driven excessively deep into the nailed object 2 in the case wherein the nailing machine 1 receives a small reaction force from the nailed object 2 during the driving operation. Furthermore, the compressed air in the below-the-piston chamber 350 serves as air damper and reduces the driving energy of the piston 300 from the beginning to end (when the piton 300 bumps against the piston bumper 360) of driving. Therefore, the shock caused by excess energy of the piston 300 on the piston bumper 360 can be reduced, improving the durability of the piston bumper 360, namely the durability of the nailing machine 1.

The nailing machine 1 of this embodiment of the present invention detects the moving distance of the body 100 relative to the nailed object 2 as a result of the reaction force the nailing machine 1 receives from the nailed object 2 to control the driving force. Therefore, there is no need of test driving and manual control of the driving force, improving the working efficiency.

(Embodiment 3)

A nailing machine 1 according to Embodiment 3 of the present invention will be described hereafter with reference to the drawings. The driving force control means of the nailing machine 1 of Embodiment 1 controls the opening/closing of the air passage 510 based on the moving distance of the body 100 relative to the push lever 700 as a result of the reaction force from the nailed object 2 so as to control the pressure in the return air chamber 500. On the other hand, the driving force control means of the nailing machine 1 of this embodiment changes the capacity of the return air chamber 500 based on the moving distance of the body 100 relative to the push lever 700 as a result of the reaction force from the nailed object 2 so as to control the pressure in the return air chamber 500. The driving force control means of the nailing machine 1 of this embodiment will be described in detail hereafter. The same structures as in the nailing machine 1 of Embodiment 1 are referred to by the same reference numbers and their explanation will be omitted.

Figure 9:
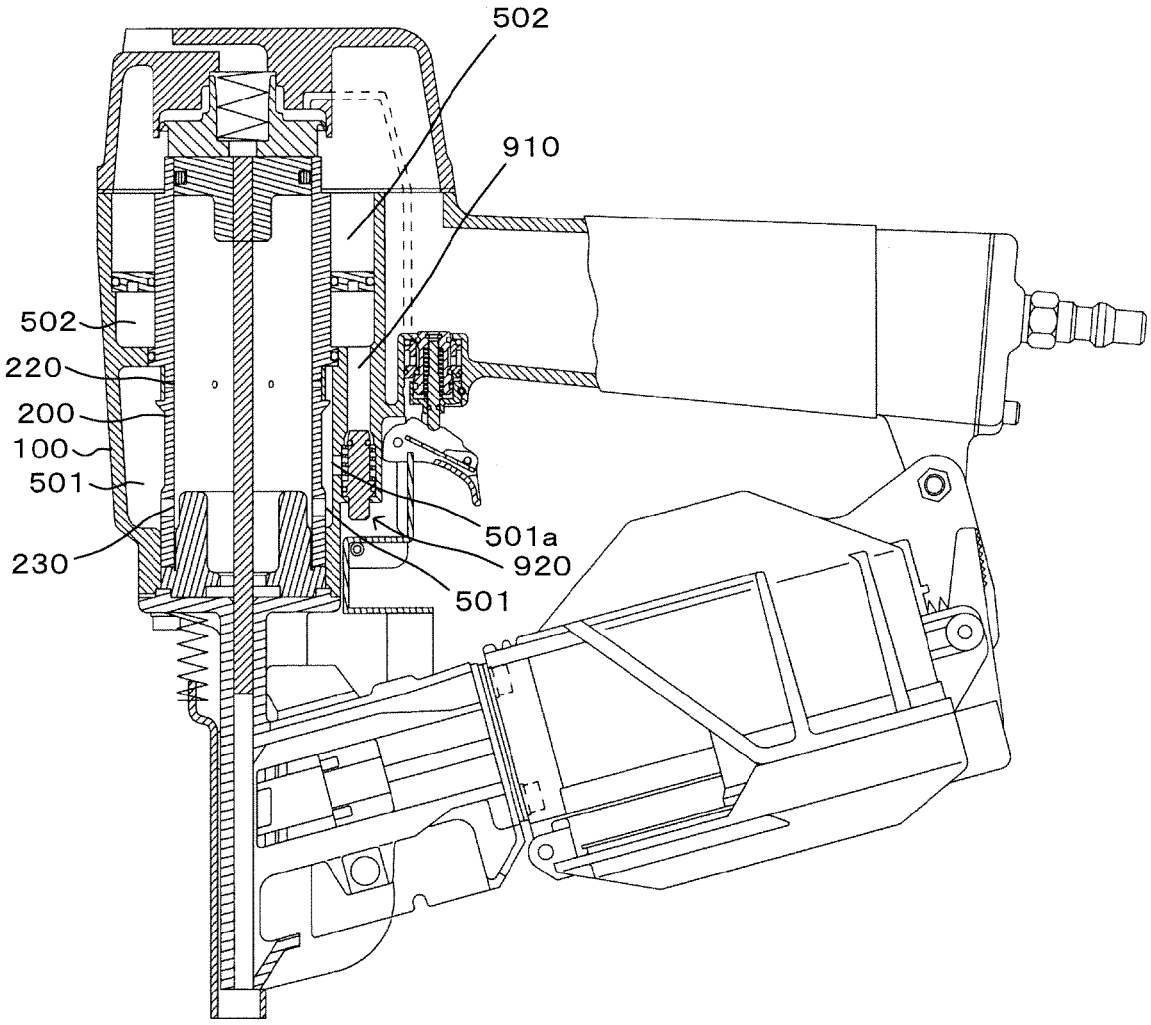
FIG. 9 is a cross-sectional view of the nailing machine according to Embodiment 3.

FIG. 9 is a cross-sectional view of the nailing machine 1 of this embodiment of the present invention. The return air chamber 500 of the nailing machine 1 of this embodiment of the present invention consists of a first return air chamber 501 and a second return air chamber 502. The driving force control means of the nailing machine 1 of this embodiment of the present invention consists of a control passage 910 allowing communication between a first return air chambers 501 and a second return air chamber 502, and a control valve 920 controlling the opening/closing of the control passage 910 based on the moving rate of the push lever 700 relative to the body 100.

The first return air chamber 501 is formed by the lower part of a cylindrical space enclosed by the cylinder 200, body 100, and cylinder plate 210. The first return air chamber 501 communicates with the cylinder 200 via air holes 220 and 230 each formed in the sidewall of the cylinder 200 in the circumferential direction. The air holes 220 and 230 have the same structures as those in Embodiment 1 and their explanation is omitted. The first return air chamber 501 has an opening 501*a* for communicating with the control passage 910.

The second return air chamber 502 is formed by the upper part of a cylindrical space enclosed by the cylinder 200, body 100, and cylinder plate 210. In other words, the second return air chamber 502 is provided above the first return chamber 501 and communicates with the first return air chamber 501 via the control passage 910.

Figure 10:
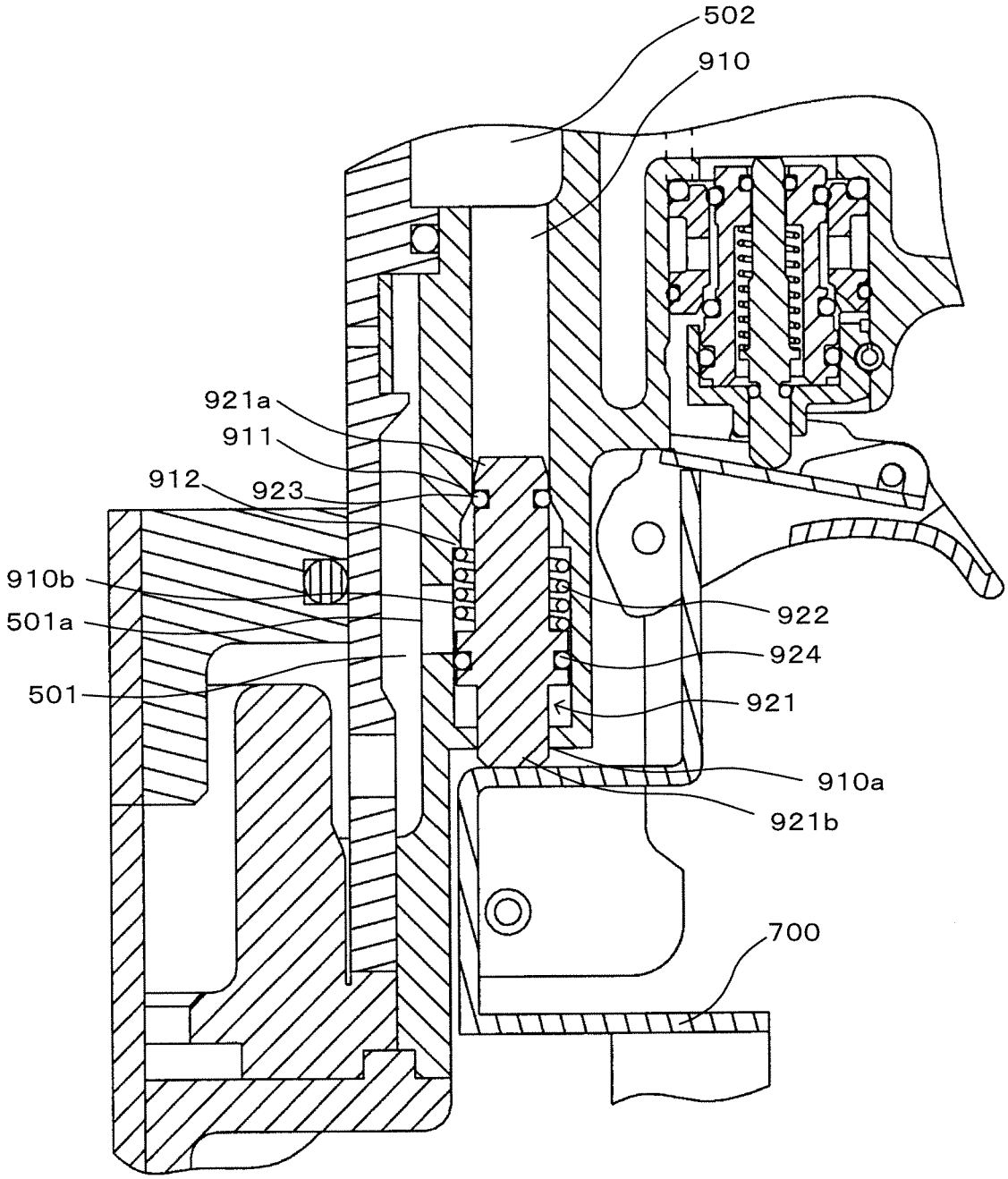
FIG. 10 is a cross-sectional view of the core part in FIG. 9.

The control passage 910 is a passage allowing communication between the first and second return air chambers 501 and 502. The control passage 910 extends in the driving direction, namely in the sliding direction of the piston 300. As shown in FIG. 10, the control passage 910 is connected to the first return air chamber 501 at one end and has at the other end an opening 910*a* opening in the driving direction from the body 100. The control passage 910 also has an opening 910*b* opening inward in the radial direction of the cylinder 200 and is connected to the first return air chamber 501 via the opening 910*b*. The peripheral surface of the control passage 910 is tapered at the part above the opening 910*b* so as to have a reduced-diameter part 911 having a passage diameter smaller than the other part for closing the control passage 910 with a closing part 921*a* of a valve member 921, which will be described later.

The control valve 920 allows or blocks entry of compressed air into the second return air chamber 502 from the first return air chamber 501. The control valve 920 consists of a valve member 921 and a spring 922.

The valve member 921 slides within the control passage 910 based on the moving rate of the push lever 700 relative to the body 100 so as to close or open the control passage 910. The valve member 921 is tapered at one end to have a closing part 921*a* having a diameter larger than the passage diameter of the reduced-diameter part 911. The other end of the valve member 921 protrudes outside the body 100 through the opening 910*a* of the control passage 910 and has an abutting part 921*b* abutting on the push lever 700. A sealing member 923 is provided to the closing part 921*a* of the valve member 921 to close the control passage 910 at the upper dead center. Furthermore, a sealing member 924 is provided to the abutting part 921*b* to prevent leakage of compressed air to the outside through the opening 910*a* of the control passage 910.

The spring 922 is a member biasing the valve member 921 downward, namely in the manner that the closing part 921*a* disengages from the reduced-diameter part 911 to open the control passage 910. The spring 922 abuts on the valve member 921 at one end and engages with an engaging part 912 formed on the peripheral surface of the control passage 910 at the other end.

The driving force control by the driving force control means of the nailing machine 1 of this embodiment will be described hereafter.

First, the behavior of the nailing machine 1 in the case wherein the nailing machine 1 receives a small reaction force from the nailed object 2 will be described. While the operator drives a nail, the push lever 700 stays abutting on the nailed object 2 because of the biasing of the spring 710. When the nailed object 2 produces a small reaction force, in the same manner as in Embodiment 1, as shown in FIG. 2, the nose 120 continues to abut on the nailed object 2 or slightly moves upward. Here, as shown in FIG. 10, the push lever 700 continues to push the valve member 921 upward against the biasing force of the spring 922 so that the closing part 921*a* of the valve member 921 engages with the reduced-diameter part 911 to close the control passage 910. In this state, the first and second return air chambers 501 and 502 do not communicate with each other. Therefore, the compressed air enters the first return air chamber 501 from the above-the-piston chamber 340. The pressure in the above-the-piston chamber 340 is decreased and the pressure in the return air chamber 500 is increased. Furthermore, the compressed air entering the below-the-piston chamber 350 from the first return air chamber 501 via the air hole 230 serves as air damper, reducing the driving force of the driver blade 330. In this way, the nail is not driven excessively deep into the nailed object 2 even in the case wherein the nailing machine 1 receives a small reaction force from the nailed object 2.

Figure 11:
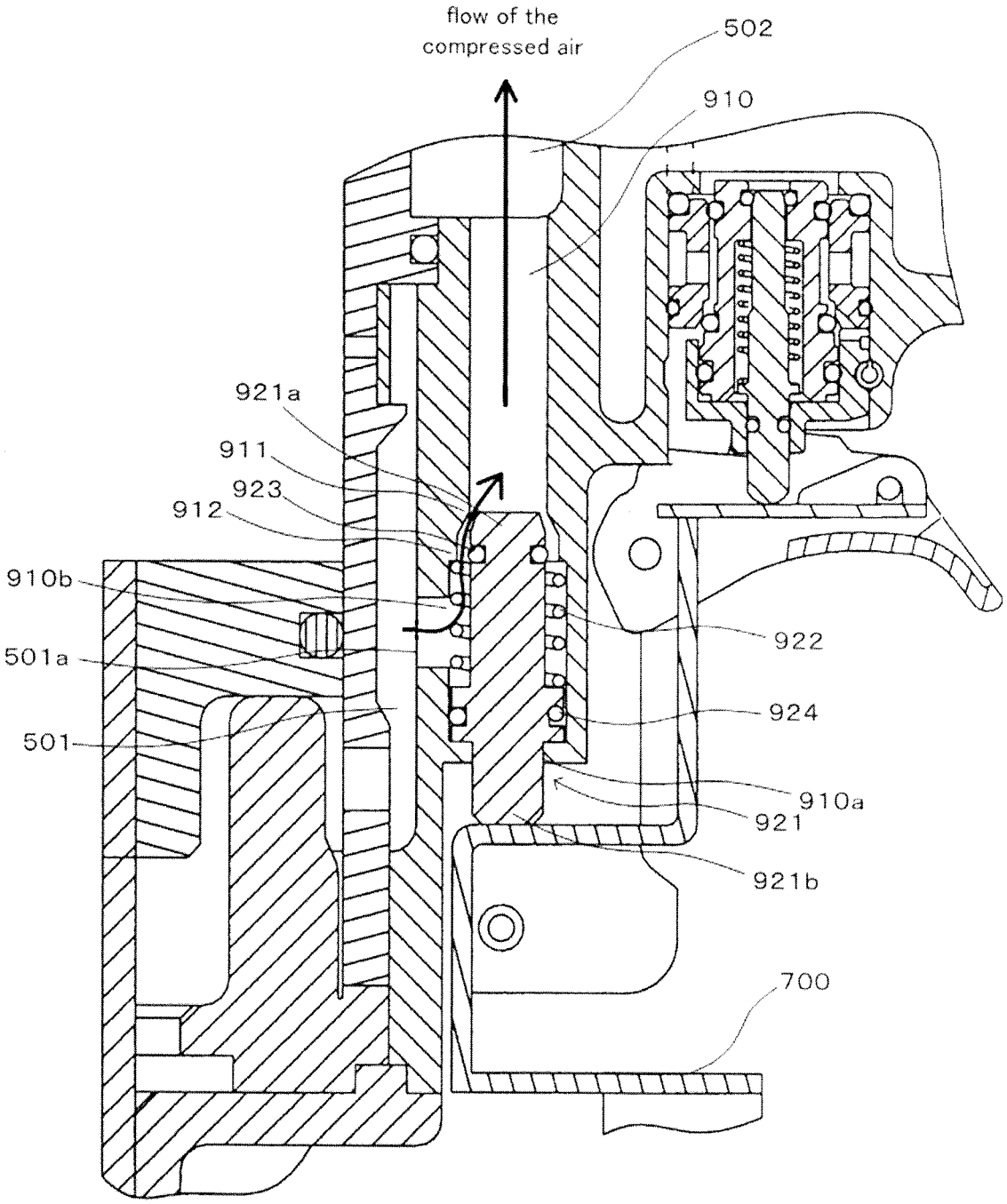
FIG. 11 is a cross-sectional view of the core part in FIG. 9.

The behavior of the nailing machine 1 in the case wherein the nailing machine 1 receives a large reaction force from the nailed object 2 will be described hereafter. When the nailed object 2 produces a large reaction force, in the same manner as in Embodiment 1, as shown in FIG. 5, the reaction force from the nailed object 2 causes the nose 120 to move away and further upward from the nailed object 2 compared to the case of a small reaction force. Since the push lever 700 continues to abut on the nailed object 2 because of the biasing force of the spring 710, the body 100 moves upward relatively to the push lever 700. Here, as shown in FIG. 11, the valve member 921 moves to the lower dead center because of the biasing force of the spring 922. Then, the closing part 921*a* of the valve member 921 disengages from the reduced-diameter part 911 of the control passage 910 to open the control passage 910. Therefore, the first and second return air chambers 501 and 502 communicate with each other and the return air chamber has a larger capacity compared to the case of a small reaction force. Consequently, the compressed air in the above-the-piston chamber 340 enters the first return air chamber 501 and then the second return air chamber 502 via the control passage 910. Then, the pressures in the first and second return air chambers 501 and 502 are low compared to the case of a small reaction force and the difference in pressure between the above-the-piston chamber 340 and the first and second return air chambers 501 and 502, namely below-the-piston chamber 350 is increased. Consequently, the compressed air that has entered the below-the-piston chamber 350 from the first and second return air chambers 501 and 502 has less effect as air damper compared to the case of a small reaction force; therefore, the driving force of the drive blade 330 is not reduced. In this way, when the nailing machine 1 receives a large reaction force from the nailed object 2, the nailing machine 1 can drive a nail into the nailed object 2 with a large driving force compared to the case of a small reaction force.

As described above, the nailing machine 1 of this embodiment of the present invention reduces the driving force of the driver blade 330 to prevent the nail from being driven excessively deep into the nailed object 2 in the case wherein the nailing machine 1 receives a small reaction force from the nailed object 2 during the driving operation. Furthermore, the compressed air in the below-the-piston chamber 350 serves as air damper and reduces the driving energy of the piston 300 from the beginning to end (when the piton 300 bumps against the piston bumper 360) of driving. Therefore, the shock caused by excess energy of the piston 300 on the piston bumper 360 can be reduced, improving the durability of the piston bumper 360, namely the durability of the nailing machine 1.

The nailing machine 1 of this embodiment of the present invention detects the moving distance of the body 100 relative to the nailed object 2 as a result of the reaction force the nailing machine 1 receives from the nailed object 2 to control the driving force. Therefore, there is no need of test driving and manual control of the driving force, improving the working efficiency.

The present invention is not confined to the above embodiments and various modifications and applications can be made thereto.

In the nailing machine 1 of Embodiment 1, the valve member 521 of the control valve 520 opens/closes the air passage 510 to control the amount of compressed air supplied to the below-the-piston chamber 350 and accordingly control the driving force. A method of controlling the driving force by another behavior of the valve member 521 will be described below.

When the pressure of compressed air supplied to the nailing machine 1 through the air plug 410 is excessively high during the nail driving, the compressed air entering through the opening of the cylinder 200 applies an excessive pressure on the top surface of the flange 521*a* of the valve member 521. This pressure causes the abutting part 521*b* of the valve member 521 to push the push lever 700 downward. The pushed push lever 700 receives a vertical reaction force from the nailed object 2 shown in FIG. 5 and, conversely, moves the body 100 upward via the valve member 521. Since the body 100 moves upward, consequently, the lower dead center of the driver blade 330 shifts away from the nailed object 2, preventing the nail from being driven deep into the nailed object 2.

In the nailing machine 1 of the above described embodiments, the opening area of the opening 511*a* of the cylinder 200 leading to the air passage 510 can be adjusted on an arbitrary basis or the closing member 541, spring 542, and valve member 521 can be selected according to the nailed object, fastener, or compressed air used so as to adjust the resistance to entry and inlet velocity and accordingly adjust the effect of the air damper. For example, the flange 521*a* of the valve member 521 can be spherical or tapered.

Furthermore, in the above embodiments, the closing member 541 provided in the air passage 510 is spherical. It can be wafer-shaped or tapered as long as the air passage 510 is closed.

Furthermore, in the above embodiments, the nailing machine 1 working with nails as fastener is explained. The present invention is not confined to the nailing machine 1 and similarly applicable to, for example, a driving machine working with staples as fastener.

Furthermore, in the above embodiments, the air passage 510 allows communication between the air hole 220 and return air chamber 500. However, the air passage 510 can be connected to the air hole 230 to guide compressed air directly to the below-the-piston chamber 350 instead of communicating with the return air chamber 500.

In the above embodiments, the nailing machine 1 having the head valve 430 as the main valve is explained. Needless to say, the main valve can be a different type of valve such as a sleeve valve.

Various embodiments and changes may be made thereunto without departing from the broad spirit and scope of the invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

The present application is based on Japanese Patent Application No. 2008-265124 and Japanese Patent Application No. 2009-227230. Their specifications, scope of patent claims, and drawings are entirely incorporated in this specification by reference.

Industrial Applicability

The present invention is preferably utilized in applications in which fasteners such as nails or staples are driven in an object.

The invention claimed is:

1. A pneumatic driving machine comprising:

a housing;

a cylinder provided in said housing;

a piston reciprocating between a first position and a second position within said cylinder and dividing the interior of said cylinder into an above-the-piston chamber and a below-the-piston chamber;

an accumulator accumulating compressed air for moving said piston from said first position to said second position;

a main valve sending said compressed air accumulated in said accumulator to said above-the-piston chamber to move said piston from said first position to said second position upon operation of a trigger;

a return air chamber communicating with said above-the-piston chamber and said below-the-piston chamber while said piston is positioned at said second position, and accumulating compressed air supplied from said above-the-piston chamber when said piston moves from said first position to said second position;

a push lever connected to said housing via a first resilient member and biased by the first resilient member to abut on a workpiece;

a driver blade fixed to said piston and hitting and driving a fastener into said workpiece; and a driving force control mechanism controlling the driving force of said driver blade for hitting said fastener based on a moving distance of said housing relative to said push lever as a result of receiving a reaction force from said workpiece upon driving said fastener, wherein:

at least said cylinder is disposed in a first air path between said accumulator and said return air chamber in said housing, at least said driving force control mechanism is disposed in a second air path between said above-the-piston chamber and said return air chamber in said housing, and said driving force control mechanism increases a resistance to said piston, by said push lever maintaining the second air path in an open state, as the moving distance of said housing relative to said push lever as a result of receiving said reaction force from said workpiece upon driving said fastener is smaller.

2. The pneumatic driving machine according to claim 1, wherein said driving force control mechanism controls the pressure in said return air chamber based on the moving distance of said housing relative to said push lever in the direction opposite to a driving direction as a result of receiving a reaction force from said workpiece upon driving said fastener.

3. The pneumatic driving machine according to claim 1, wherein said driving force control mechanism increases the pressure in said return air chamber as the moving distance of said housing relative to said push lever is smaller.

4. The pneumatic driving machine according to claim 1, wherein said driving force control mechanism comprises a control valve allowing or blocking entry of compressed air into said return air chamber from said above-the-piston chamber via a check valve based on the moving distance of said housing relative to said push lever.

5. The pneumatic driving machine according to claim 4, wherein said return air chamber communicates with said above-the-piston chamber via a control passage extending in a driving direction and having a reduced-diameter part having a passage diameter;

said control valve comprises:

a valve member sliding within said control passage in the driving direction and provided with one end having a diameter larger than the passage diameter of said reduced-diameter part and closing said control passage when engaging with said reduced-diameter part, and a second resilient member biasing said one end of said valve member in the driving direction so that said one end engages with said reduced-diameter part; and said push lever pushes the other end of said valve member in a direction opposite to the driving direction against the biasing force of said second resilient member so that said one end of said valve member disengages from said reduced-diameter part when the moving distance of said housing relative to said push lever is smaller than a predetermined distance.

6. The pneumatic driving machine according to claim 1, wherein said driving force control mechanism comprises a control valve controlling the resistance to entry of compressed air from said above-the-piston chamber based on the moving distance of said housing relative to said push lever.

7. The pneumatic driving machine according to claim 6, wherein said return air chamber communicates with said above-the-piston chamber via a control passage extending in a driving direction and having a reduced-diameter part having a passage diameter; and said control valve comprises:

a closing member placed in said control passage, having a diameter larger than the passage diameter of said reduced-diameter part, and closing said control passage when engaging with said reduced-diameter part, a second resilient member biasing said closing member in the direction opposite to the driving direction so that said closing member engages with said reduced-diameter part, a pin having one end abutting on the opposite end of said second resilient member to the end abutting on said closing member so as to be biased in the driving direction, and a moving mechanism moving said pin within said control passage in the driving direction based on the moving distance of said housing relative to said push lever.

8. The pneumatic driving machine according to claim 1, further comprising a second return air chamber communicating with said return air chamber via an air passage, wherein said driving force control mechanism comprises a control valve controlling the opening/closing of said air passage based on the moving distance of said housing relative to said push lever.

9. A pneumatic driving machine comprising:

a housing;

a cylinder provided in said housing;

a piston reciprocating between a first position and a second position within said cylinder and dividing the interior of said cylinder into an above-the-piston chamber and a below-the-piston chamber;

an accumulator accumulating compressed air for moving said piston from said first position to said second position;

a main valve sending said compressed air accumulated in said accumulator to said above-the-piston chamber to move said piston from said first position to said second position upon operation of a trigger;

a return air chamber communicating with said above-the-piston chamber and said below-the-piston chamber while said piston is positioned at said second position, and accumulating compressed air supplied from said above-the-piston chamber when said piston moves from said first position to said second position;

a push lever connected to said housing via a first resilient member and biased by the first resilient member to abut on a workpiece;

a driver blade fixed to said piston and hitting and driving a fastener into said workpiece; and a driving force control mechanism controlling the driving force of said driver blade for hitting said fastener based on a moving distance of said housing relative to said push lever as a result of receiving a reaction force from said workpiece upon driving said fastener, wherein:

said driving force control mechanism increases a resistance to said piston as the moving distance of said housing relative to said push lever as a result of receiving said reaction force from said workpiece upon driving said fastener is smaller, said return air chamber communicates with said above-the-piston chamber via a control passage extending in a driving direction and having a reduced-diameter part having a passage diameter, said control valve comprises:

a closing member placed in said control passage, having a diameter larger than the passage diameter of said reduced-diameter part, and closing said control passage when engaging with said reduced-diameter part, a second resilient member biasing said closing member in the direction opposite to the driving direction so that said closing member engages with said reduced-diameter part, a pin having one end abutting on the opposite end of said second resilient member to the end abutting on said closing member so as to be biased in the driving direction, and a moving mechanism moving said pin within said control passage in the driving direction based on the moving distance of said housing relative to said push lever, said driving force control mechanism comprises a control valve controlling the resistance to entry of compressed air from said above-the-piston chamber based on the moving distance of said housing relative to said push lever, and said moving mechanism comprises a locker arm that has one end pushing the other end of said pin in the direction opposite to the driving direction and the other end abutting on a third resilient member fixed to said housing at one end so as to be biased in the driving direction and abutting on said push lever so as to be pushed in the direction opposite to the driving direction, and that is rotatable about a rotation axis positioned between the two ends.

10. A pneumatic driving machine comprising:

a housing;

a cylinder provided in said housing;

a piston reciprocating between a first position and a second position within said cylinder and dividing the interior of said cylinder into an above-the-piston chamber and a below-the-piston chamber;

an accumulator accumulating compressed air for moving said piston from said first position to said second position;

a main valve sending said compressed air accumulated in said accumulator to said above-the-piston chamber to move said piston from said first position to said second position upon operation of a trigger;

a return air chamber communicating with said above-the-piston chamber and said below-the-piston chamber while said piston is positioned at said second position, and accumulating compressed air supplied from said above-the-piston chamber when said piston moves from said first position to said second position;

a second return air chamber communicating with said return air chamber via an air passage;

a push lever connected to said housing via a first resilient member and biased by the first resilient member to abut on a workpiece;

a driver blade fixed to said piston and hitting and driving a fastener into said workpiece; and a driving force control mechanism controlling the driving force of said driver blade for hitting said fastener based on a moving distance of said housing relative to said push lever as a result of receiving a reaction force from said workpiece upon driving said fastener, wherein:

said driving force control mechanism increases a resistance to said piston as the moving distance of said housing relative to said push lever as a result of receiving said reaction force from said workpiece upon driving said fastener is smaller, said driving force control mechanism comprises a control valve controlling the opening/closing of said air passage based on the moving distance of said housing relative to said push lever, said air passage includes a control passage extending in a driving direction and having a reduced-diameter part having a passage diameter;

said control valve comprises:

a valve member sliding within said control passage in the driving direction and provided with one end having a diameter larger than the passage diameter of said reduced-diameter part and closing said control passage when engaging with said reduced-diameter part, and a second resilient member having one end fixed to said housing and the other end abutting on said valve member to bias said valve member in the driving direction; and said push lever pushes the other end of said valve member in the direction opposite to the driving direction against the biasing force of said second resilient member so that said one end of said valve member engages with said reduced-diameter part when the moving distance of said housing relative to said push lever is smaller than a predetermined distance.

* * * * *